US006024097A

United States Patent [19]

Von Wielligh

[11] Patent Number: 6,024,097

[45] Date of Patent: Feb. 15, 2000

[54] PRODUCT FOR ASSISTING A SMOKER IN GIVING UP THE HABIT

[75] Inventor: Johannes Luow Kotze Von Wielligh, Cape Town, South Africa

[73] Assignee: J Mom Trust, Tortola, Virgin Islands (Br.)

[21] Appl. No.: 09/054,261

[22] Filed: Apr. 3, 1998

Related U.S. Application Data

[63] Continuation-in-part of application No. 08/200,527, Feb. 23, 1994, abandoned, which is a continuation of application No. 08/018,395, Feb. 17, 1993, abandoned.

[30] Foreign Application Priority Data

Feb. 20, 1992 [ZA] South Africa ..... 92/1245
Sep. 2, 1992 [ZA] South Africa ..... 92/6655

[51] Int. Cl.[7] ..... A24F 47/00

[52] U.S. Cl. ..... 131/270; 131/273; 514/343

[58] Field of Search ..... 131/270, 273, 131/335; 514/343

[56] References Cited

U.S. PATENT DOCUMENTS

| | | | |
|---|---|---|---|
| 3,155,573 | 11/1964 | Fowler . | |
| 3,757,798 | 9/1973 | Lambert | 131/270 |
| 3,870,794 | 3/1975 | Hutchinson et al. | 424/264 |
| 4,393,884 | 7/1983 | Jacobs | 131/273 |
| 4,579,858 | 4/1986 | Ferno et al. | 514/343 |
| 4,635,651 | 1/1987 | Jacobs | 131/270 |
| 4,735,217 | 4/1988 | Gerth et al. | 131/273 |
| 4,765,347 | 8/1988 | Sensabaugh et al. | 131/273 |
| 4,793,366 | 12/1988 | Hill | 131/273 |
| 4,813,437 | 3/1989 | Ray | 131/273 |
| 4,860,738 | 8/1989 | Hegemann et al. | 128/200.2 |
| 4,920,989 | 5/1990 | Rose et al. | 131/270 |
| 4,945,929 | 8/1990 | Egilmex | 131/273 |
| 4,953,572 | 9/1990 | Rose et al. | 131/270 |
| 4,961,727 | 10/1990 | Beard | 604/75 |
| 5,055,478 | 10/1991 | Copper et al. | 514/343 |

*Primary Examiner*—Stanley S. Silverman
*Assistant Examiner*—Jacqueline A. Ruller
*Attorney, Agent, or Firm*—Archie W. Umphlett

[57] ABSTRACT

A product for assisting a smoker in giving-up the smoking habit consists of at least three and preferably four pump operated aerosol dispensers. Each dispenser, apart from one, contains nicotine in liquid form dispersed in at least one pharmaceutically acceptable carrier. The dispensers which container nicotine have differing quantities in them. Pharmaceutically acceptable carriers are water, alcohol, a flavoring, glycerine and saccharine. The volume of alcohol and glycerine increases as the percentage of nicotine decreases. The dispenser which does not contain nicotine merely comprises one or more pharmaceutically acceptable substances.

11 Claims, 1 Drawing Sheet

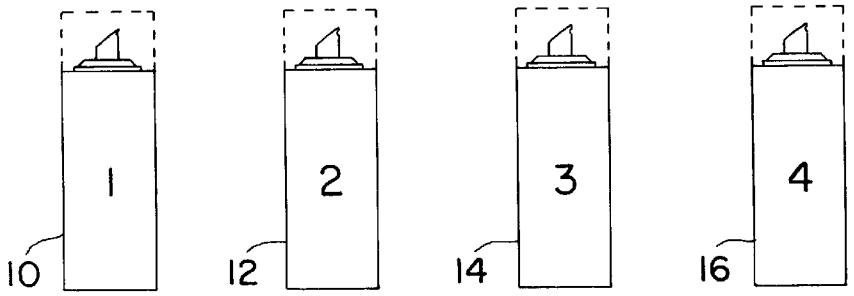
FIG. 1
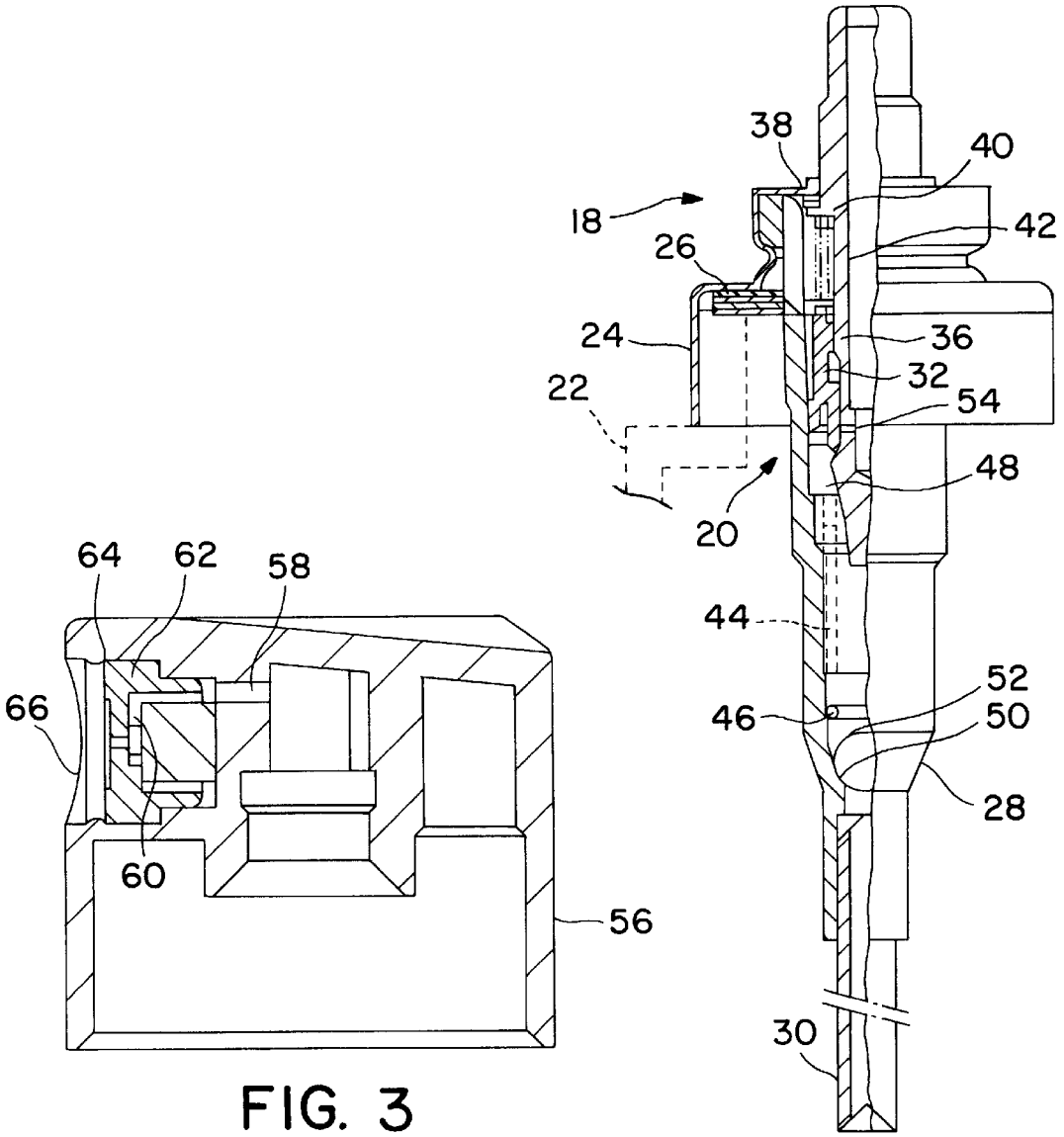
FIG. 3
FIG. 2

PRODUCT FOR ASSISTING A SMOKER IN GIVING UP THE HABIT

This is a continuation-in-part application of application Ser. No. 08/200,527 filed Feb. 23, 1994, now abandoned, which is a continuation application of application Ser. No. 08/018,395 filed Feb. 17, 1993, now abandoned.

FIELD OF THE INVENTION

This invention relates to a product for assisting a smoker in giving-up the smoking habit.

BACKGROUND TO THE INVENTION

Cigarette smoke contains a large number of very complex substances the most important of which is nicotine, this being the substance to which cigarette smokers develop an addiction. Upon a cigarette smoker ceasing to smoke, withdrawal symptoms and a craving for a cigarette occur which result from the body's need for nicotine. To alleviate the effect of these withdrawal symptoms and the craving for a cigarette it has been proposed that the person attempting to break the smoking habit should be given decreasing doses of nicotine. This enables the nicotine level in the body to be reduced over a period of time which results in the withdrawal symptoms being less severe. Chewing gum with nicotine in it and tablets containing nicotine have been marketed and, in the period since my original application Ser. No. 08/018,395 was filed, a nasal spray containing nicotine has been marketed. Pads which are applied to the skin are also available. Pads of various sizes are provided, the pads containing nicotine. The nicotine is absorbed steadily through the skin. The concept is that a large pad is used initially when the person attempting to give-up the smoking habit requires a high level of nicotine in his or her body to prevent withdrawal symptoms. Pads of progressively decreasing size are used as the body becomes less dependent on nicotine. In this regard reference is made to U.S. Pat. No. 4,920,989 which discloses such pads.

The concept of inhaling nicotine from an aerosol device is also known and reference can be made to U.S. Pat. Nos. 4,813,437 and 4,945,929. The purpose of such devices is to provide the user with the nicotine that his or her body requires without simultaneously inhaling the smoke, tars and other harmful substances found in cigarettes. Thus the known aerosol products are substitutes for cigarettes and do not assist a smoker in ridding himself or herself of nicotine addiction. Nicotine addiction is the main reason why giving up the smoking habit is so difficult.

In U.S. Pat. No. 4,920,989, the concept of using both pads and an aerosol spray is disclosed. The pads, as explained above, provide the reducing nicotine intake over a period of time thereby to diminish the addict's need for the nicotine. The aerosol spray provides droplets with a size range of 1 micron to 10 microns. The smallest droplets, with a size of about 1 micron to about 5 microns, are intended to stimulate the lower respiratory tract and the larger droplets, from about 5 microns to about 10 microns, are intended to stimulate the upper respiratory tract.

The aerosol spray of U.S. Pat. No. 4,920,989 comprises a canister containing a pharmaceutically acceptable carrier, a propellant gas and a nicotine in liquid form. A valve controls flow of the contents of the canister into a tube through an opening in a side wall of the tube. At one end of the tube there is a filter and at the other end of the tube there is a mouthpiece. When the valve is opened, a mist comprising small droplets is formed in the tube. The user then sucks on the mouthpiece thereby to draw air through the filter, through the tube, through the oral cavity and into the respiratory tract. The air flowing from the filter to the mouthpiece entrains the droplets and carries them to the respiratory tract. The droplets must be small to enable them to be entrained in inhaled air and to remain entrained whilst being carried to the respiratory tract.

The total volume of droplets in the mist in the tube depends on the time period for which the valve is held open. A short opening period results in a low droplet concentration and a long opening period results in a high droplet concentration. The total volume of the droplets drawn from the tube depends on the droplet concentration and on how long the user sucks on the mouthpiece. These two variables combined result in wide variations in the nicotine doses that the nicotine addict receives when the aerosol spray of U.S. Pat. No. 4,920,989 is used. There is no disclosure in U.S. Pat. No. 4,920,989 of providing a series of canisters each with less nicotine in it than in the preceding ones.

Another method of providing a nicotine intake which reduces over a period of time is to be found in U.S. Pat. No. 3,757,798. In that specification chewing tobacco or snuff is packaged in a saliva permeable infusion bag and the bag placed in the addict's mouth. Saliva penetrates the bag, nicotine and other solubles in the tobacco are dissolved in the saliva, and are ingested into the stomach and intestines when the saliva is swallowed. From the stomach and intestines the nicotine presumably enters the blood stream.

The rate at which nicotine is dissolved from such a bag depends on two variable factors. Firstly, the quantity of nicotine varies widely, some tobaccos containing 10% or more nicotine than others. Hence, bags used in identical manner, but containing tobacco with different nicotine contents, will provide different doses of nicotine. The second variable is that if the bag is sucked vigorously to moisten it, the rate at which nicotine is absorbed will be increased to above the absorbtion rate which will be obtained if the bag is simply placed between, for example, the gum and the cheek and not disturbed.

Variations in the rate at which nicotine is absorbed also result from the use of other substances. For example, a carbonated beverage will diminish for a period of time the rate at which nicotine can be ingested.

The variations in nicotine intake resulting from these variables completely masks any reduction in nicotine intake that would result from the use of a series of bags each with less tobacco in it than the preceding one. Obviously, by using tobacco from the same crop and conducting careful laboratory tests to determine nicotine content before using the tobacco, some of the variations in nicotine content can be eliminated. However, the rate at which the nicotine is absorbed still varies with the way in which the bag is used and what it is used with. In addition to all these problems, the concept of placing a tobacco filled bag in the mouth would not now be acceptable to most people. Even many heavy cigarette smokers would balk at this concept.

OBJECT OF THE INVENTION

The object of the present invention is to provide an efficacious product and delivery system for assisting a person in giving-up the smoking habit.

BRIEF SUMMARY OF THE INVENTION

According to the present invention there is provided a plurality of dispensers each of which, apart from one, contains nicotine in liquid form dispersed in at least one pharmaceutically acceptable carrier, the percentage of nicotine by volume in each dispenser being different to the percentage of nicotine in each other dispenser, and said one dispenser having therein said at least one pharmaceutically acceptable carrier but no nicotine.

In a now preferred embodiment of the invention a method of assisting a smoker in giving up the smoking habit is provided which method comprises providing a plurality of pump operated aerosol dispensers each of which contains nicotine in liquid form dispersed in at least one pharmaceutically acceptable carrier, the percentage by volume of nicotine in each dispenser being different to the percentage by volume of nicotine in each other dispenser, and using each dispenser in turn, commencing with the one having the highest nicotine content and terminating with the one having the lowest nicotine content, to spray in droplet form the carrier and the liquid nicotine into the oral cavity so that the droplets impinge on the mucous membranes.

In a further now preferred embodiment of the invention there is provided a method of assisting a smoker in giving up the habit which comprises spraying into the oral cavity from a pump operated aerosol dispenser liquid nicotine dispersed in at least one pharmaceutically acceptable carrier, a dose of carrier and nicotine being sprayed into the oral cavity each time the smoker feels the effects of nicotine withdrawal, the method further comprising providing at least two dispensers, the dispensers containing different volumes of nicotine, and using the dispenser containing the greatest volume of nicotine before using the dispenser or dispensers having lesser volumes of nicotine.

In a still further now preferred embodiment of the invention there is provided a nicotine addiction treatment package comprising two pump operated aerosol dispensers each of which comprises a container and a hand operated pump and each of which has therein liquid nicotine dispersed in at least one pharmaceutically acceptable carrier, the percentage by volume of liquid nicotine in one of the containers being greater than the percentage by volume in the other of the containers, each dispenser having a bore through which the carrier and nicotine are ejected in the form of a spray, each bore having a diameter of between 0.25 and 0.45 mm.

There should be at least three dispensers, two dispensers having nicotine therein with the volume of nicotine in one of the dispensers being greater than the percentage of nicotine in the other of these dispensers, the third dispenser containing said at least one pharmaceutically acceptable carrier but no nicotine.

It is preferred that there be four dispensers, three dispensers having nicotine therein with the percentage of nicotine in each of these dispensers being different to the percentage in each of the other dispensers the fourth dispenser having therein at least one pharmaceutically acceptable carrier but no nicotine.

The dispensers can contain about 1,5%, about 1,0%, about 0,5% and 0,0% by volume nicotine. By way of example, the percentage of nicotine in the three dispensers can be 1,45%, 0,97% and 0,48%. Experimentation has shown that four 20 ml dispensers containing these volumes of nicotine provides a suitable treatment for a person smoking about 30 cigarettes per day.

The dispensers are pump operated so that depressing the plunger once dispenses a predetermined volume of liquid from the dispensers. Preferably the volume is about 70 microliters. This minimises the risk that the person may receive too heavy a dose which can occur if an aerosol container of the type which contains a propellant under pressure is used.

Suitable pharmaceutically acceptable liquid carriers are alcohol, water, glycerine, saccharine and a flavouring such as peppermint. The alcohol can occupy the greatest volume eg from 75% to 85%, the volume of alcohol increasing as the percentage of nicotine decreases. There can be between 10% and 20% glycerine, the volume of glycerine increasing as the volume of nicotine decreases. The peppermint flavour can be about 4% by volume and the saccharine a trace eg 0.1% by volume.

The present invention will now be described with reference to the accompanying drawings in which:

FIG. 1 illustrates a set of four pump operated aerosol dispensers in accordance with the present invention;

FIG. 2 is a detail, to a larger scale, of the pump structures of the dispensers of FIG. 1; and FIG. 3 is a detail, to an even larger scale, of a cap and nozzle.

DETAILED DESCRIPTION OF THE INVENTION

The following table sets out the constituents of the four illustrated dispensers 10, 12, 14 and 16 each of which has a volume of 20 ml and the nicotine content of which ranges from 1.45% to 0% and which is suitable for the treatment, over a period of about 1 month, of a person who at the beginning of the treatment is smoking about 30 cigarettes per day.

| | Disp. 10 | Disp. 12 | Disp. 14 | Disp. 16 |
|---|---|---|---|---|
| Nicotine | 1.45 | 0.97 | 0.48 | 0.00 |
| Alcohol | 79.71 | 80.10 | 80.49 | 80.88 |
| Saccharine | 0.12 | 0.12 | 0.12 | 0.12 |
| Glycerine | 14.78 | 14.85 | 14.93 | 15.00 |
| Peppermint Flavour | 3.94 | 3.96 | 3.98 | 4.00 |

All figures are percentages by volume. All or some of the alcohol can be replaced by water.

The dispensers and the packaging of the dispensers are marked with appropriate directions. For example, the dispensers can be numbered 1 to 4 as shown in FIG. 1 and marked with instructions such as "Use the contents of this dispenser first" or "Use the contents of this dispenser before using dispensers 2, 3 or 4". The nature of the directions is not critical provided that they ensure that the nicotine addict understands that the dispensers are to be used in a particular order.

The droplets sprayed into the oral cavity impact on the mucous membranes of the oral cavity and the nicotine is absorbed through the mucous membranes into the blood stream.

The dispensers 10, 12, 14 and 16 of FIG. 1 are shown in more detail in FIGS. 2 and 3. The dispenser 18 of FIG. 2 is of commercially available form and is conventionally used to dispense liquids such as perfumes, aftershaves etc. A pump structure 20 is within the container is designated 22 and is secured to the container by means of cap 24. The cap 24 is crimped or otherwise compressed onto a neck 22.1 of the container 22. A gasket 26 seals between the container 22 and the cap 24. The pump structure 20 further includes a hollow elongate body 28 which is fixed to the cap 24 by crimping the cap onto the body 28. The body 28 is extended downwardly by a dip tube 30.

The pump of the pump structure 20 is designated 32 and comprises a piston 34 which can slide vertically in the body 28. The piston 34 is of annular form and an actuator 36 passes through the piston 34.

The actuator 36 protrudes through the cap 24 and there is a sealing gasket 38 between the cap 24 and the top face of a shoulder 40 on the actuator 36. A spring 42 acts between the underface of the shoulder 40 and the piston 34.

A further spring 44 is provided between an internal annular face 46 of the body 28 and a face 48 of the actuator 36.

Close to its lower end the body 28 has an internal tapering seat 50 and a ball 52 is positioned within the body 28. The lower end of the dip tube 30 is open. A hole is provided at 54 in the actuator 36 so as to connect the hollow interior of the actuator to the exterior.

The actuator 36 is surmounted by a cap 56 (FIG. 3) which is a press fit on the upper end of the actuator 36. An internal passage 58 of the cap 56 places the hollow interior of the actuator 36 in communication with a chamber 60 which is behind a nozzle 62. The nozzle 62 pressed into a socket 64 of the cap 56. At the centre of the nozzle 60 there is a fine bore 66.

When the cap 54 and actuator 36 are pressed down, liquid within the body 28 below the actuator is pressurized. The ball 52 is urged against its seat 50 and prevents liquid flowing from the body back into the container 22. The pressurized liquid flows via the passage 58 to the fine bore 66 and emerges as a spray from the bore 66.

Because of the size of the droplets, they travel from the bore 66 directly onto the membranes of the oral cavity and do not tend to drift about. Instinctively, a person spraying into the mouth does not simultaneously breath in. Hence there is little prospect that significant quantities of the liquid sprayed from the dispenser will be drawn into the respiratory tract.

The bore 66 has a diameter of between 0.25 and 0.45 mm and preferably 0.35 mm. Bores of this size provide droplets which are large enough to travel from the bore to the mucous membrane without drifting. The spray cone angle B (shown in dashed lines in FIG. 3) is 45 degrees.

The person wishing to give up smoking, upon feeling the need for a cigarette, takes the dispenser which contains most nicotine (that which would usually be numbered 1) and, in the same way that breath fresheners are used, sprays into his or her oral cavity. One depression of the plunger is sufficient to dispense a suitable amount of liquid in atomized form. A suitable amount of liquid is approximately 70 microliters.

The first dispenser is used each time that nicotine withdrawal symptoms are felt until it is exhausted. The second aerosol dispenser is then used in the same way and it will be understood that the person is, immediately the second dispenser is brought into use, receiving a smaller dose of nicotine per depression of the pump than was being received during the use of the first dispenser. Thus while nicotine is still being provided, the amount provided has been decreased. Once the second dispenser has been depleted the third dispenser is brought into use and subsequently the fourth dispenser which has therein no nicotine whatsoever. Thus the nicotine level of the addict is decreased progressively and the effects of a sudden reduction in the nicotine level in the body are avoided.

I claim:

1. A method of assisting a smoker in giving up the smoking habit which comprises providing a plurality of pump operated aerosol dispensers each of which contains nicotine in liquid form dispersed in at least one pharmaceutically acceptable carrier and each of which has an outlet bore through which the nicotine and carrier can be sprayed in droplet form, the percentage by volume of nicotine in each dispenser being different to the percentage by volume of nicotine in each other dispenser, and using each dispenser in turn, commencing with the one having the highest nicotine content and terminating with the one having the lowest nicotine content, by spraying in droplet form the carrier and the liquid nicotine in a predetermined volume into the oral cavity so that the droplets impinge on the mucous membranes and the nicotine is absorbed thereby without significant quantities' of nicotine entering the respiratory tract.

2. A method according to claim 1, in which three dispensers with differing volume of nicotine therein and one dispenser which does not have nicotine therein are provided.

3. A method of assisting a smoker in giving up the smoking habit which comprises spraying, in droplet form into the oral cavity through the outlet bore of a pump operated aerosol dispenser a predetermined volume of liquid nicotine dispersed in at least one pharmaceutically acceptable carrier, a dose of carrier and nicotine being sprayed into the oral cavity each time the smoker feels the effect of nicotine withdrawal so that the droplets impinge on the mucous membranes and the nicotine is absorbed thereby without significant quantities' of nicotine entering the respiratory tract, the method further comprising providing at least two dispensers, the dispensers containing different volumes by percentage of nicotine, and using the dispenser containing the greatest volume by percentage of nicotine before using the dispenser or dispensers having lesser volumes by percentage of nicotine.

4. A method of treating a smoker to assist the smoker in giving up the smoking habit which comprises spraying into the oral cavity, as a series of doses of predetermined volume, droplets comprising liquid nicotine dispersed in at least one pharmaceutically acceptable carrier so that the droplets impinge on the mucous membranes and the nicotine is absorbed thereby without significant quantities' of nicotine entering the respiratory tract, the nicotine and carrier being sprayed into the oral cavity from a first pump operated aerosol dispenser which has an outlet bore through which the nicotine and carrier can be sprayed in droplet form until the first dispenser is exhausted, and thereafter spraying into the oral cavity, as a series of doses of predetermined volume, nicotine dispersed in at least one pharmaceutically acceptable carrier from a second pump operated aerosol dispenser which has an outlet bore through which the nicotine and carrier can be sprayed in droplet form until the second dispenser is exhausted, the percentage by volume of nicotine in the first dispenser being greater than the percentage by volume of nicotine in the second dispenser.

5. A method according to claim 4 and which further comprises spraying into the oral cavity from a third pump operated aerosol dispenser, as a series of doses, liquid nicotine dispersed in at least one pharmaceutically acceptable carrier, the nicotine being sprayed from said third pump operated aerosol dispenser into the oral cavity until said third dispenser is exhausted and the third dispenser containing a smaller percentage by volume of nicotine than either of the first and second dispensers.

6. A method according to claim 4, which further comprises spraying into the oral cavity, after the second dispenser has been exhausted and as a series of doses from a pump operated aerosol dispenser, a pharmaceutically acceptable carrier with a flavourant dispersed therein but without liquid nicotine dispersed therein.

7. A method according to claim 5, which further comprises spraying into the oral cavity, after the third dispenser has been exhausted and as a series of doses from a pump operated aerosol dispenser, a pharmaceutically acceptable carrier with a flavourant dispersed therein but without liquid nicotine dispersed therein.

8. A nicotine addiction treatment package comprising at least two pump operated aerosol dispensers each of which comprises a container and a hand operated pump and each of which has therein liquid nicotine dispersed in at least one pharmaceutically acceptable carrier, the percentage by volume of liquid nicotine in one of the containers being greater than the percentage by volume in the other containers, each dispenser having a bore through which a predetermined volume of the carrier and nicotine can be sprayed into the oral cavity in droplet form so that the droplets impinge on the mucous membranes and are absorbed thereby without significant quantities' entering the respiratory tract, each bore having a diameter of between 0.25 and 0.45 mm.

9. A package according to claim 8 and including a third dispenser having therein liquid nicotine dispersed in at least one pharmaceutically acceptable carrier, the percentage by volume of nicotine in said third dispenser being less than the percentage by volume of nicotine in either of the first and second dispensers.

10. A package according to claim 9, and including a fourth dispenser having therein at least one pharmaceutically acceptable carrier and a flavourant but being devoid of liquid nicotine.

11. A package according to claim 8 in which the spray angle is 45 degrees.

* * * * *